US006546688B1

(12) United States Patent
Parsons

(10) Patent No.: US 6,546,688 B1
(45) Date of Patent: Apr. 15, 2003

(54) ROOFING SHINGLE HAVING AN INSULATING MATERIAL AND ASSOCIATED METHOD FOR MAKING THE SAME

(76) Inventor: Colbey Lynn Parsons, 920 W. 4th St., Greenfield, IN (US) 46140

( * ) Notice: Subject to any disclaimer, the term of this patent is extended or adjusted under 35 U.S.C. 154(b) by 0 days.

(21) Appl. No.: 09/624,706

(22) Filed: Jul. 24, 2000

Related U.S. Application Data

(63) Continuation-in-part of application No. 09/296,507, filed on Apr. 22, 1999, now Pat. No. 6,125,609.

(51) Int. Cl.[7] ..... E04D 1/22
(52) U.S. Cl. ..... 52/518; 52/408
(58) Field of Search ..... 52/518, 408, 309.1, 52/309.8

(56) References Cited

U.S. PATENT DOCUMENTS 4,032,491 A * 6/1977 Schoenke ..... 260/28.5
4,450,663 A 5/1984 Watkins
4,668,315 A * 5/1987 Brady et al. ..... 156/71
5,258,222 A 11/1993 Crivelli
5,347,785 A * 9/1994 Terrenzio et al. ..... 52/555
5,382,475 A 1/1995 Kayser
5,411,803 A 5/1995 George et al.
5,540,022 A 7/1996 Morris
5,600,929 A 2/1997 Morris
6,194,519 B1 * 2/2001 Blalock et al. ..... 525/232

OTHER PUBLICATIONS

Encyclopedia Britannica Online <http://www.search.eb-.com/bol/topic?eu=63624&sctn=1>.*

* cited by examiner

*Primary Examiner*—Carl D. Friedman
*Assistant Examiner*—Jennifer I. Thissell
(74) *Attorney, Agent, or Firm*—Barnes & Thornburg

(57) ABSTRACT

A roofing shingle includes a substrate layer which is adapted to be secured to a roof of a building. The roofing shingle also includes an insulator layer co-extruded or otherwise secured to the substrate layer. The insulator layer includes a resin film having borosilicate implanted therein. A method of fabricating a roofing shingle is also disclosed.

18 Claims, 3 Drawing Sheets

ROOFING SHINGLE HAVING AN INSULATING MATERIAL AND ASSOCIATED METHOD FOR MAKING THE SAME

This application is a continuation-in-part application of U.S. Pat. No. 6,125,609, patented Oct. 3, 2000, U.S. patent application Ser. No. 09/296,507, filed on Apr. 22, 1999, entitled "Roofing Shingle Assembly" by Colbey L. Parsons.

TECHNICAL FIELD OF THE INVENTION

The present invention relates generally to roofing shingle, and more particularly to roofing shingle having an insulating material and associated method for making the same.

BACKGROUND OF THE INVENTION

Roofing shingles are widely utilized on the roof of a residential or commercial building to protect the roof from the elements such as water, snow, wind, and ultraviolet rays from the sun. Heretofore designed roofing shingles typically include a tar and/or asphalt substrate with a number of granules secured thereto. The granules are often made from ground up, recycled road material (e.g. asphalt) and are provided to both protect the substrate and also increases the rigidity of the shingle by reducing the 'elasticity' of the substrate.

One drawback associated with heretofore designed roofing shingles is that the shingles themselves provide little to no insulation to the building. In fact, heretofore designed roofing shingles often absorb heat in hot climates and transfer such heat through the roof and into the attic and/or upper floors of the building. Such a heat transfer into the building increases costs associated with cooling the building.

Moreover, another drawback associated with heretofore designed roofing shingles is the material content thereof. Although, as described above, certain roofing shingle designs have utilized granules that are formed from recycled road surfaces, recycled materials have not commonly been utilized in the other components of the roofing shingle such as the substrate.

What is needed therefore is roofing shingle that overcomes one or more of the above-mentioned drawbacks. What is particularly needed is a roofing shingle that has a relatively high insulating value. What is also particularly needed is a roofing shingle that may be easily constructed and utilizes numerous recycled components.

SUMMARY OF THE INVENTION

In accordance with one embodiment of the present invention, there is provided a roofing shingle. The roofing shingle includes a substrate layer which is adapted to be secured to a roof of a building. The roofing shingle also includes an insulator layer secured to the substrate layer. The insulator layer includes borosilicate.

In accordance with another embodiment of the present invention, there is provided a method of fabricating a roofing shingle. The method includes the step of fabricating a substrate layer. The substrate layer is adapted to be secured to a roof of a building. The method also includes the step of fabricating an insulator layer which includes borosilicate. The method yet further includes the step of securing the substrate layer and the insulator layer to one another.

In accordance with a further embodiment of the present invention, there is provided a method of fabricating a roofing shingle. The method includes the step of fabricating a substrate layer. The substrate layer is adapted to be secured to a roof of a building. The method also includes the step of implanting an insulating material into a resin film. Yet further, the method includes the step of securing the resin film to the substrate layer.

In accordance with yet another embodiment of the present invention, there is provided a roofing shingle. The roofing shingle includes substrate adapted to be secured to a roof of a building. The roofing shingle also includes a resin film secured to the substrate. The resin film has an insulating material implanted therein.

In accordance with a further embodiment of the present invention, there is provided a method of fabricating a roofing shingle. The method includes the step of implanting an insulating material into a film so as to form an implanted film. The method also includes the step of co-extruding the implanted film with a substrate material so as to form a co-extruded composite material. Yet further, the method includes the step of altering the shape of the co-extruded composite material so as to form the roofing shingle.

In accordance with another embodiment of the present invention, there is provided a roof assembly for a building. The roof assembly includes a wooden deck. The roof assembly also includes a roofing shingle secured to the wooden deck. The roofing shingle is prepared by a process including the steps of (i) implanting an insulating material into a film so as to form an implanted film, (ii) co-extruding the implanted film with a substrate material so as to form a co-extruded composite material, and (iii) altering a shape of the co-extruded composite material so as to form the roofing shingle.

It is therefore an object of the present invention to provide a new and useful roofing shingle.

It is moreover an object of the present invention to provide an improved roofing shingle.

It is also an object of the present invention to provide a new and useful roofing assembly for a building.

It is further an object of the present invention to provide an improved roofing assembly for a building.

It is yet further object of the present invention to provide a new and useful method of making a roofing shingle.

It is also an object of the present invention to provide an improved method of making a roofing shingle.

It is also an object of the present invention to provide roofing shingle which has a relatively high insulating value.

It is yet further an object of the present invention to provide a roofing shingle that is constructed of numerous recycled components.

The above and other objects, features, and advantages of the present invention will become apparent from the following description and the attached drawings.

DETAILED DESCRIPTION OF THE INVENTION

Figure 1:
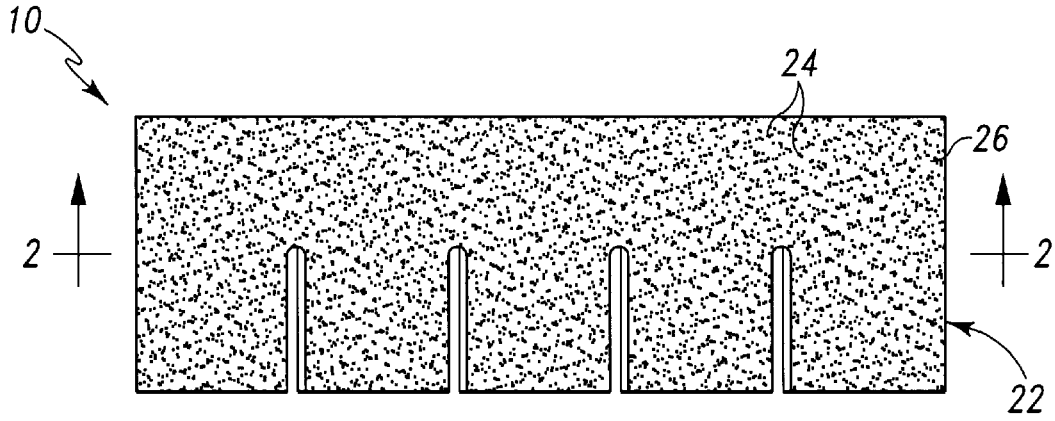
FIG. 1 is a perspective view of a roofing shingle which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
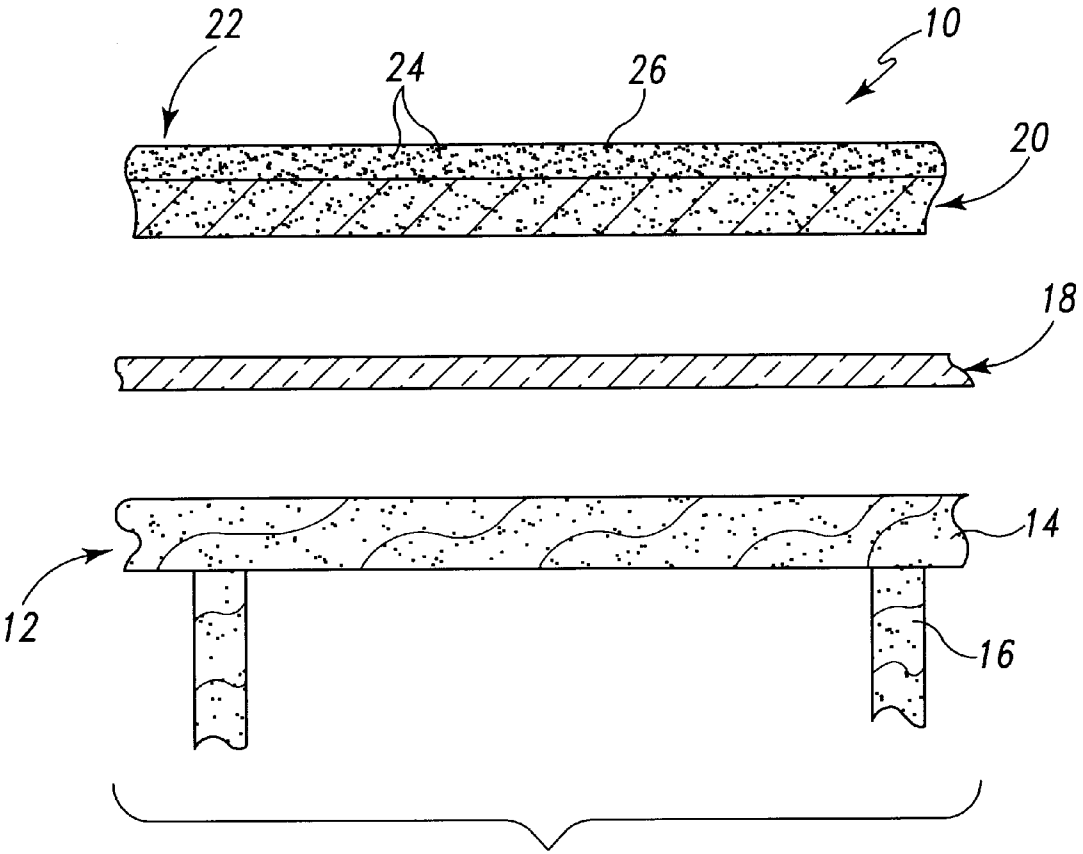
FIG. 2 is a cross sectional view taken along the line 2—2 of FIG. 1, as viewed in the direction of the arrows, note that FIG. 2 also shows a weatherproofing liner and the roof to which the roofing shingle is secured.

Referring now to FIGS. 1 and 2, there is shown a roofing shingle 10. The roofing shingle 10 is adapted to be secured to a roof assembly 12 of a residential or commercial building (not shown). In particular, the roofing shingle 10 is typically nailed or otherwise secured to a wooden deck 14 of the roof assembly 12. As shown in FIG. 2, the wooden deck 14 is typically supported by a number of wooden beams 16 associated with the roof assembly 12. A weatherproofing liner 18 is interposed between the roofing shingle 10 and the wooden deck 14 of the roof assembly 12 in order to help prevent the intrusion of moisture into the wooden deck 14.

The roofing shingle 10 includes a substrate layer 20 and an insulator layer 22. The substrate layer 20 may be constructed of any type of material which is suitable for use in a roofing shingle. Examples of such suitable materials include asphalt and tar based material. However, as shall be discussed below in greater detail, the substrate layer 20 is preferably constructed from a re-vulcanized rubber. One re-vulcanized rubber which is particularly useful for construction of the substrate layer 20 is a thermoplastic vulcanate (TPV). Thermoplastic vulcanate is a crumb rubber-based material that has been chemically processed into a thermoplastic. One specific example of a thermoplastic vulcanate is commercially available from Landstar, Incorporated of Dayton, Ohio.

The insulator layer 22 on the other hand includes an insulating material 24 which is implanted into a thin film 26. The insulating material 24 may be any type of insulating material which, when implanted into the thin film 26, reduces heat absorption into the roof assembly 12. For example, the insulating material 24 of the present invention may be embodied as a cyclosilicate. Certain cyclosilicates are characterized by relatively high insulating properties that derive from their relatively high thermal emissivity properties. In particular, certain cyclosilicates are particularly good insulators in the sense that they emit thermal energy back into the surrounding air, as opposed to absorbing such thermal energy and transferring it through the roofing shingle 10 and into the building. One cyclosilicate that has been found to be particularly useful as the insulating material 24 of the present invention is borosilicate.

Alternatively, certain igneous materials have also been found to demonstrate a relatively high thermal emissivity property thereby functioning as a relatively favorable insulating material 24. One such igneous material that has been found to be particularly useful as the insulating material 24 of the present invention is purlite.

As alluded to above, there is no intent to limit the present invention to the use of borosilicate or purlite as the insulating material 24. Conversely, although the use of borosilicate and purlite provides numerous advantages to the present invention, certain of such advantages may be achieved by use of other insulating materials are also contemplated for use herein as the insulating material 24.

The thin film 26 may be embodied as any type of film such as a resin, polymer, or olefin film which has the desired properties of a given roofing shingle design. In particular, the insulating material 24 (e.g. borosilicate) is preferably implanted into the thin film 26 via injection molding so as to form an implanted material composite which is later co-extruded or otherwise secured to the substrate layer 20. Hence, the thin film 26 is preferably constructed of a natural or synthetic material which is capable of being processed in the aforedescribed manner. One thin film 26 which has been found to be particularly useful as the thin film 26 of the present invention is ethyl vinyl acetate which is commercially available from PPG Industries of Pittsburgh, Pa.

In a specific exemplary embodiment, the insulator layer 22 is provided as a composite of borosilicate and an olefin film. In particular, borosilicate granules are implanted into a thin film of ethyl vinyl acetate. One preferable manner to implant the borosilicate granules into the thin film of ethyl vinyl acetate is by injection molding. As shall be discussed below in greater detail, the resultant implanted insulator layer 22 is then secured to the substrate layer 20 so as to form the roofing shingle 10.

In certain configurations, it may be desirable to include a number of silica or mica granules in the roofing shingle 10. As with a conventional roofing shingle, the addition of silica or mica granules may be utilized to provide additional protection to the substrate layer 20. In such a case, the silica or mica granules may be injection molded (along with the insulating granules 24) into the thin film 26.

The substrate layer 20 and the insulator layer 22 may be secured to one another in any one of numerous manners. One particularly useful manner for securing the layers 20, 22 to one another is to co-extrude the two layers 20, 22 together. Hence, in the specific exemplary embodiments described above, a substrate stock of thermoplastic vulcanate is co-extruded with insulator layer material constructed of a thin film of ethyl vinyl acetate having borosilicate granules implanted therein.

Hence, when used herein, the term "layer" is not intended to mean that the material associated therewith is strictly discrete from the material associated with other "layers". For example, the co-extrusion process causes materials from the insulator layer 22 to be co-mingled with materials from the substrate layer 20.

The resultant co-extruded composite material including the substrate and insulator layers 22, 24 may be formed into any shape or configuration by the co-extrusion process. However, the co-extrusion process preferably forms the resultant composite material into a relatively flat stock of material which may be die cut or otherwise formed so as to assume the general configuration of the roofing shingle 10 shown in FIG. 1.

Figure 3:
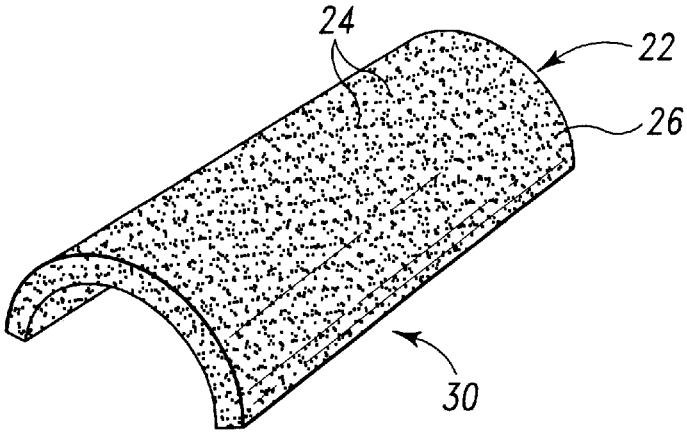
FIGS. 3 and 4 are perspective views of alternative configurations of the roofing shingle of FIG. 1.
Figure 4:
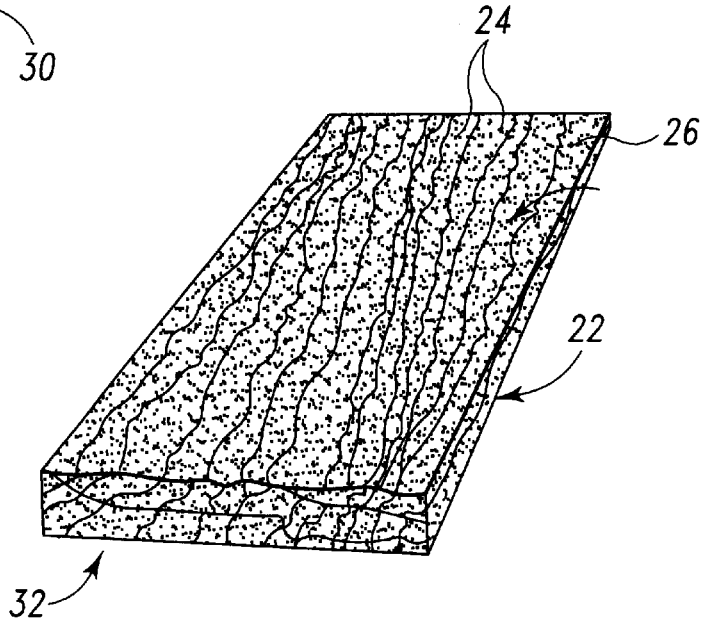

However, it should be appreciated that the co-extrusion process may alternatively be configured to produce roofing shingles of various designs and shapes. For example, the co-extrusion process may be configured to produce a stock that when die-cut (or otherwise singulated) produces a Spanish shingle 30 (see FIG. 3) or a shake shingle 32 (see FIG. 4).

OPERATION OF THE PRESENT INVENTION

Figure 5:
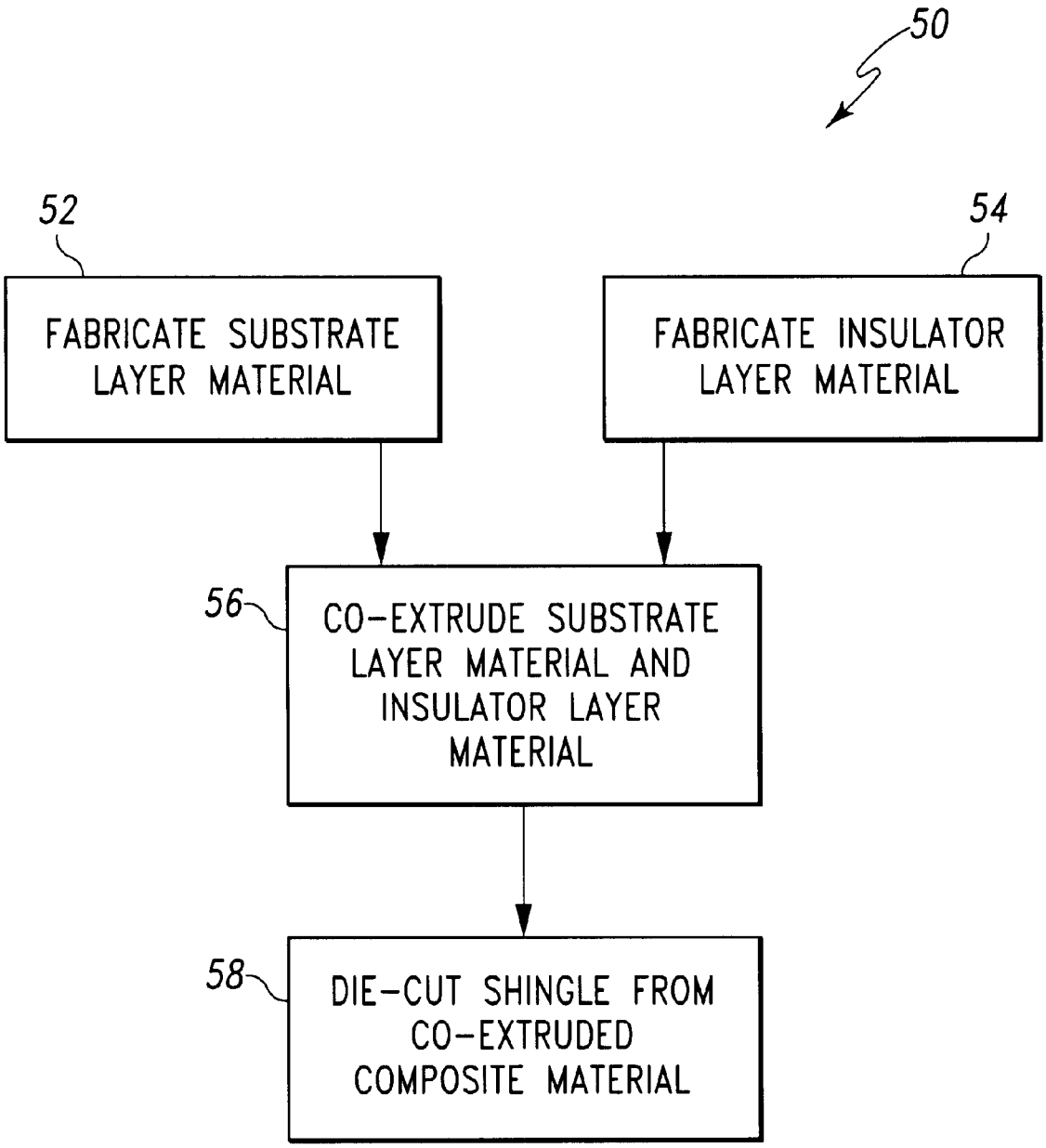
FIG. 5 is a flowchart which shows a fabrication process for fabricating the roofing shingle of FIG. 1.

In operation, the roofing shingle 10 of the present invention may be fabricated by a fabrication process 50 described in reference to the flowchart shown in FIG. 5. The fabrication process 50 begins with step 52 in which the material for the substrate layer 20 is fabricated. In particular, as described above, the substrate layer 20 is preferably constructed from a re-vulcanized rubber such as a thermoplastic vulcanate (TPV). Hence, in step 52, crumb rubber-based material is chemically processed into the desired thermoplastic. The resultant intermediate product of thermoplastic vulcanate is preferably provided as a continuously rolled stock.

The fabrication process 50 also includes step 54 in which the insulator layer 22 is fabricated. In particular, as described above, the insulator layer 22 is preferably provided as a composite of borosilicate and an olefin film. More specifically, borosilicate granules are implanted into a thin film of ethyl vinyl acetate via injection molding. The resultant implanted insulator layer 22 is preferably provided on a continuously rolled stock.

Moreover, as discussed above, in certain configurations, it may be desirable to include a number of silica or mica granules in the roofing shingle 10. As with a conventional roofing shingle, the addition of silica or mica granules may be utilized to provide additional protection to the substrate layer 20. In such a case, the silica or mica granules may be injection molded (along with the insulating granules 24) into the thin film 26 in step 54.

The fabrication process 50 then advances to step 56 in which the material of the substrate layer 20 and the material of the insulating layer 22 are secured to one another in any one of numerous manners. Preferably, the material associated with the layers 20, 22 is secured to one another via co-extrusion. Hence, in the specific exemplary embodiment described herein, the rolled stock of thermoplastic vulcanate and the rolled stock of the composite insulator layer material (i.e. the thin film of ethyl vinyl acetate having borosilicate granules implanted therein) are both advanced into an extrusion machine (not shown) so as to be co-extruded with one another.

The resultant co-extruded composite material including the substrate layer 20 and insulator layers 22 may be formed into any shape or configuration by the extrusion machine. However, the extrusion machine preferably forms the co-extruded composite material into a relatively flat stock of material which may be die-cut or otherwise formed so as to assume the general configuration of the roofing shingle 10 shown in FIG. 1. However, the extrusion machine may also be configured to produce a stock that when die-cut (or otherwise singulated) produces the Spanish shingle 30 (see FIG. 3) or the shake shingle 32 (see FIG. 4).

Thereafter, the resultant co-extruded composite material is advanced through a forming machine which alters the shape of the composite material so as to form the shingle 10 (or shingles 30, 32, as desired). In particular, the co-extruded composite material may be advanced through a die-cutting machine which singulates or otherwise cuts the composite material into the desired shingle shape and configuration.

Thereafter, the individual roofing shingles may be bundled for storage and/or shipping.

Hence, as described herein, the roofing shingle 10 (along with the associated manufacturing process) provides numerous advantages over heretofore designed roofing shingles. For example, the roofing shingle 10 provides significant insulating advantages to a roofing assembly constructed therewith relative to heretofore designed, non-insulated shingles. In particular, the roofing shingle 10 of the present invention emits the thermal energy that is directed thereon from the sun back into the surrounding air thereby preventing such thermal energy from being directed into the building. Moreover, the fabrication process described herein may be utilized to quickly and easily produce insulated shingles from recycled components thereby reducing the costs associated with manufacture of the roofing shingles.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

There are a plurality of advantages of the present invention arising from the various features of the roofing shingle described herein. It will be noted that alternative embodiments of the roofing shingle of the present invention may not include all of the features described yet still benefit from at least some of the advantages of such features. Those of ordinary skill in the art may readily devise their own implementations of a roofing shingle that incorporate one or more of the features of the present invention and fall within the spirit and scope of the present invention as defined by the appended claims.

For example, the concepts of the present invention may be utilized in the construction of other types of building materials. For example, the concepts of the present invention may be utilized in the construction of insulated floorings such as sidewalk pavers or insulated wallboards.

What is claimed is:

1. A roofing shingle, comprising:

a substrate layer which is adapted to be secured to a roof of a building; and an insulator layer secured to said substrate layer, said insulator layer comprising borosilicate.

2. The roofing shingle of claim 1, wherein said insulator layer includes a resin film with said borosilicate being implanted into said resin film.

3. The roofing shingle of claim 2, wherein said borosilicate is injection molded into said resin film.

4. The roofing shingle of claim 2, wherein said resin film includes an olefin film.

5. The roofing shingle of claim 2, wherein said resin film includes a polymer film.

6. The roofing shingle of claim 1, wherein said substrate layer includes a re-vulcanized rubber material.

7. The roofing shingle of claim 1, wherein said substrate layer is co-extruded with said insulator layer so as to be secured thereto.

8. A roofing shingle, comprising:

a substrate adapted to be secured to a roof of a building; and a resin film secured to said substrate, said resin film having an insulating material implanted therein, wherein said insulating material includes a cyclosilicate.

9. The roofing shingle of claim 8, wherein said insulating material includes borosilicate which is implanted into said resin film.

10. The roofing shingle of claim 8, wherein said insulating material is injection molded into said resin film.

11. The roofing shingle of claim 8, wherein:

said resin film includes an olefin film, and said insulating material is implanted into said olefin film.

12. The roofing shingle of claim 8, wherein:

said resin film includes an polymeric film, and said insulating material is implanted into said polymeric film.

13. The roofing shingle of claim 8, wherein said substrate is constructed from a re-vulcanized rubber material.

14. The roofing shingle of claim 8, wherein said substrate layer and said resin film are co-extruded.

15. A roof assembly for a building, comprising:

a wooden deck; and a roofing shingle secured to said wooden deck, said roofing shingle being prepared by a process including the steps of (i) implanting an insulating material into a film so as to form an implanted film, wherein said insulating material includes a cyclosilicate, (ii) co-extruding said implanted film with a substrate material so as to form a co-extruded composite material, and (iii) altering a shape of said co-extruded composite material so as to form said roofing shingle.

16. The roofing shingle of claim 15, wherein said altering step includes the step of die cutting said co-extruded composite material so as to form said roofing shingle.

17. The roofing shingle of claim 15, wherein:

said substrate material includes a thermoplastic vulcanate material, and said co-extruding step includes the step of co-extruding said implanted film with said thermoplastic vulcanate so as to form said co-extruded composite material.

18. The roofing shingle of claim 15, wherein:

said insulating material includes borosilicate, and said implanting step includes the step of implanting said borosilicate into said film.

* * * * *